US012650049B2

(12) United States Patent
Luu et al.

(10) Patent No.: US 12,650,049 B2
(45) Date of Patent: Jun. 9, 2026

(54) SYSTEM FOR GENERATING BIT WEAR MODEL PREDICTIONS AND RELATED METHODS

(71) Applicant: Baker Hughes Oilfield Operations LLC, Houston, TX (US)

(72) Inventors: Trieu Phat Luu, Houston, TX (US); Xu Huang, Spring, TX (US); John Abhishek Raj Bomidi, Peral River, NY (US); Edward Furlong, Cypress, TX (US)

( * ) Notice: Subject to any disclaimer, the term of this patent is extended or adjusted under 35 U.S.C. 154(b) by 483 days.

(21) Appl. No.: 18/315,366

(22) Filed: May 10, 2023

(65) Prior Publication Data

US 2024/0376786 A1 Nov. 14, 2024

(51) Int. Cl.
*E21B 12/02* (2006.01)

(52) U.S. Cl.
CPC ..... *E21B 12/02* (2013.01); *E21B 2200/22* (2020.05)

(58) Field of Classification Search
CPC ..... E21B 12/02; E21B 2200/22
See application file for complete search history.

(56) References Cited

U.S. PATENT DOCUMENTS 11,125,022 B2 * 9/2021 Potash ..... E21B 12/02
2008/0158004 A1 * 7/2008 Latrille ..... E21B 47/13 340/853.1
2019/0145183 A1 5/2019 Potash
2019/0345809 A1 11/2019 Jain et al.
2020/0051237 A1 * 2/2020 Spivey ..... E21B 41/00
2021/0358100 A1 * 11/2021 Lyles ..... G06T 7/30
2022/0282609 A1 * 9/2022 Samuel ..... E21B 47/002
2024/0102362 A1 * 3/2024 Huang ..... G06F 30/27

FOREIGN PATENT DOCUMENTS

WO WO-2015005923 A1 * 1/2015 ..... E21B 47/007
WO 2021/236316 A1 11/2021

OTHER PUBLICATIONS

International Search Report for Application No. PCT/US2024/028257 dated Sep. 6, 2024, 4 pages.
International Written Opinion for Application No. PCT/US2024/028257 dated Sep. 6, 2024, 4 pages.

* cited by examiner

*Primary Examiner* — Mi'schita' Henson
(74) *Attorney, Agent, or Firm* — Baker Hughes Company

(57) ABSTRACT

An earth-boring tool system may include a drill string and at least one or more sensors. The earth-boring tool system may receive field drilling data, logging while drilling (LWD) data, and data indicative of wear of at least part of a drilling tool, train a predictive bit wear model based on the received data, fit a wear trajectory regression curve to a latent space representation of the received data, and generate one or more predicted dull states of the at least one drilling tool based, at least in part, on the predictive bit wear model and the wear trajectory regression curve. The earth-boring tool system may also generate one or more similarity scores responsive to comparing the first drilling data to target data and filter the first drilling data or a latent space representation of the first drilling data responsive to the one or more similarity scores.

19 Claims, 7 Drawing Sheets

SYSTEM FOR GENERATING BIT WEAR MODEL PREDICTIONS AND RELATED METHODS

TECHNICAL FIELD

Embodiments of the present disclosure relate generally to systems and methods for developing predictive bit wear models for earth-boring tools.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using earth-boring tools, such as an earth-boring rotary drill bit. The earth-boring rotary drill bit is rotated and advanced into the subterranean formation. As the earth-boring rotary drill bit rotates, the cutting elements, cutters, or abrasive structures thereof cut, crush, shear, and/or abrade away the formation material to form the wellbore.

The earth-boring rotary drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom-hole assembly" (BHA).

Additionally, various machine learning techniques may be used to classify, interpret, or generate data by training a machine-learning based model. A machine learning based model may be given an input and a desired output and may then extract patterns from the data to "learn" how to achieve the desired output given the input data. For example, one type of machine learning involves the use of neural networks. A neural network may include layers of nodes, an input layer, one or more hidden layers, and an output layer. Each node of a neural network may be configured to communicate with one or more other nodes of the neural network based on the input, one or more parameters of a given node, and weights assigned to those parameters to generate an output. During a training process, the neural network may automatically adjust the parameter values or weights associated with the parameter values based on provided desired outputs to better achieve a desired output given an input.

One example of a machine learning model may include an encoder-decoder model. An encoder-decoder model may include two neural networks. For example, a first neural network (the "encoder") of an encoder-decoder model may take data as input and output a latent space representation of the input by extracting and representing identified features of the input. The second neural network (the decoder) may take the output of the first neural network as an input to produce a decoded output. For example, an encoder-decoder model may be used to translate a sentence from one language to a different language. As a specific example, a sentence in English may be input to an encoder-decoder model trained to translate English to German. The encoder part of the model may then extract one or more features from the input to produce a latent space representation of that input. The decoder part of the model may then take as input this latent space representation to produce a translated sentence in German that is based on the input.

BRIEF SUMMARY

Some embodiments of the present disclosure include an earth-boring tool system. The earth-boring tool system may include a drill string comprising at least one drilling tool, one or more sensors configured to sense wear of the at least one drilling tool, at least one processor, at least one non-transitory computer readable storage medium storing instructions thereon that, when executed by the at least one processor, cause the earth-boring tool system to receive first drilling data including field drilling data, logging while drilling (LWD) data and data indicative of wear of at least part of the at least one drilling tool, train at least one predictive bit wear model for predicting one or more dull states of the at least one drilling tool based, at least in part, on the first drilling data, the predictive bit wear model configured to encode the first drilling data into a latent space representation of the first drilling data, fit a wear trajectory regression curve to the latent space representation of the first drilling data, and generate one or more predicted dull states of the at least one drilling tool based, at least in part, on the predictive bit wear model and the wear trajectory regression curve.

Further embodiments of the present disclosure include a method for obtaining a bit wear model. The method may include receiving first drilling data from an earth-boring tool system, the first drilling data including field drilling data, logging while drilling (LWD) data and data indicative of wear of at least part of the at least one drilling tool, training at least one predictive bit wear model for predicting one or more dull states of the at least one drilling tool based, at least in part, on the first drilling data, the predictive bit wear model configured to encode the first drilling data into a latent space representation of the first drilling data, generating one or more similarity scores responsive to comparing the latent space representation of the first drilling data to target drilling data, and filtering the latent space representation of the first drilling data responsive to the one or more similarity scores.

Further embodiments of the present disclosure may include a non-transitory computer readable storage medium storing instructions thereon that, when executed by the at least one processor, cause the earth-boring tool system to receive first drilling data including field drilling data, logging while drilling (LWD) data, and data indicative of wear of at least part of the at least one drilling tool, training at least one predictive bit wear model for predicting one or more dull states of the at least one drilling tool based, at least in part, on the first drilling data, the predictive bit wear model configured to encode the first drilling data into a latent space representation of the first drilling data, generating one or more similarity scores responsive to comparing the latent space representation of the first drilling data to target drilling data, filtering the latent space representation of the first drilling data responsive to the one or more similarity scores, fitting a wear trajectory regression curve to the filtered latent space representation of the first drilling data, and generating one or more predicted dull states of the at least one drilling tool based, at least in part, on the predictive bit wear model and the wear trajectory regression curve.

BRIEF DESCRIPTION OF THE SEVERAL VIEWS OF THE DRAWINGS

While this disclosure concludes with claims particularly pointing out and distinctly claiming specific examples, various features and advantages of examples within the scope of this disclosure may be more readily ascertained from the following description when read in conjunction with the accompanying drawings, in which:

DETAILED DESCRIPTION

Figure 1:
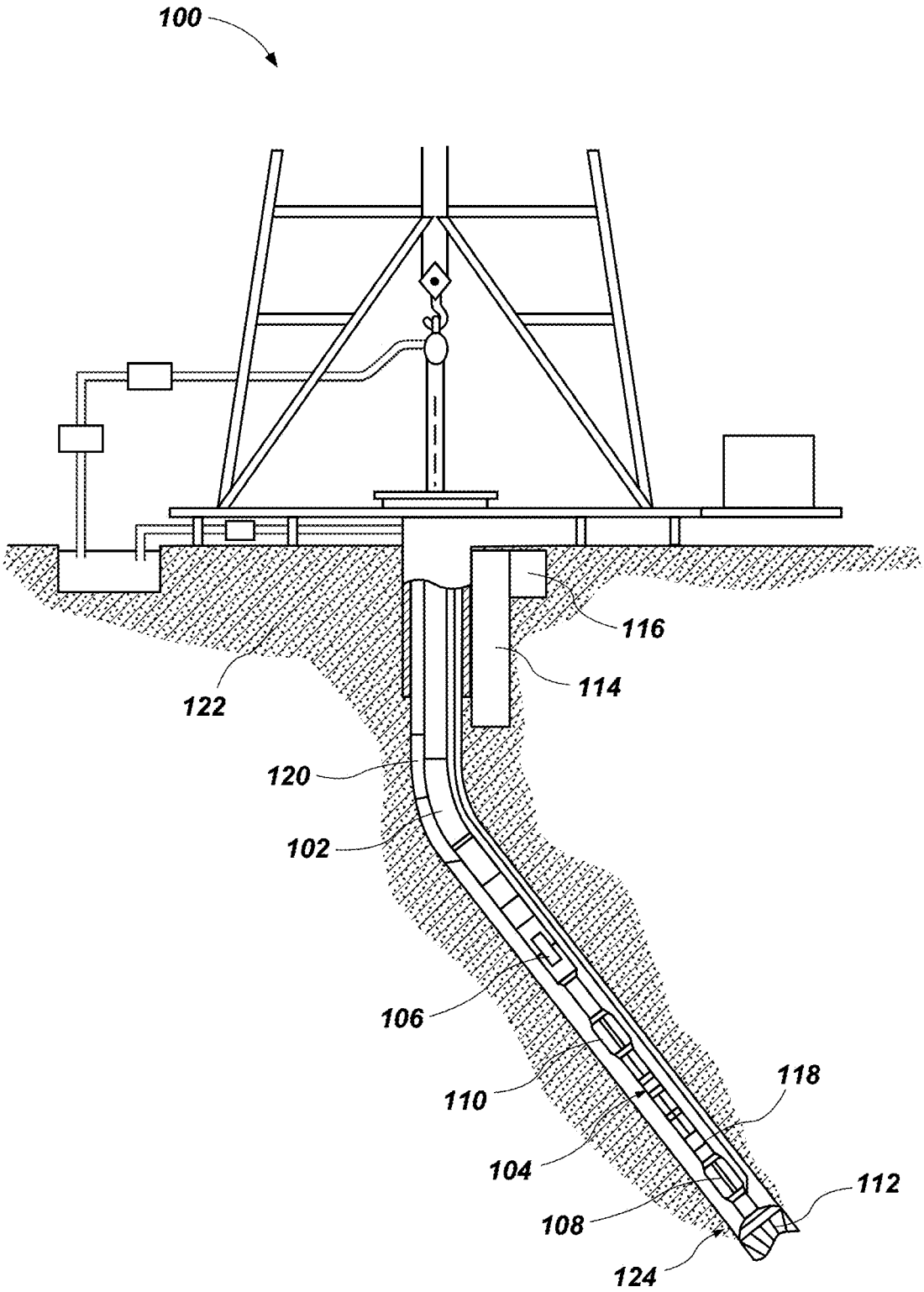
FIG. 1 is a schematic view of an example earth-boring tool system according to one or more embodiments of the present disclosure.

Downhole drilling operations may involve the use of an earth-boring tool at the end of a long string of pipe commonly referred to as a drill string. An earth-boring tool may be used for drilling through subterranean formations, such as rock, dirt, sand, tar, etc. In some cases, the earth-boring tool may be configured to drill through additional elements that may be present in a wellbore, such as cement, casings (e.g., a wellbore casing), discarded or lost equipment (e.g., fish, junk, etc.), packers, etc. Each element will cause various parts of the earth-boring tool to wear or break down from the act of drilling through them. As various parts of the earth-boring tool wears down, it becomes increasingly likely that at least a part of the earth-boring tool will break, which may sometimes lead to part of, or all of an earth-boring tool being dislodged from the drill string and becoming irretrievably lost within the wellbore. This may result in significant losses of time as well as the loss expensive equipment which may both reduce the efficiency of the drilling operation and require complete replacement of expensive drilling equipment.

Accordingly, to prevent earth-boring tools from wearing down to the point of breaking within a wellbore, an machine learning based bit wear model may be provided to predict the wear of an earth-boring tool so that the tool can be repaired or replaced before breaking within a wellbore. Moreover, by creating a bit wear model, various operating parameters of the drill string may be optimized to reduce wear on the earth-boring tool during operation and maximize the drilling distance of the earth-boring tool before at least part of the earth-boring tool must be repaired or replaced. Typically, this bit wear model may be created by using field data collected from real-time field trials. However, because of physical constraints, it is difficult to measure the wear of an earth boring tool outside of the first few feet of the wellbore. Thus, for a run with several hundreds or thousands of feet of drilling distance, the measured field data may be limited to the initial and final few feet of the entire drilling operation. For example, field data is typically limited to a sharp beginning state of the earth-boring tool (e.g., the first few feet when the earth-boring tool drills into the earth) and an end dull state (e.g., the last few feet after the drill has bored into the earth and is being removed from the wellbore. Moreover, the field data may exhibit large amounts of noise (e.g., sharp variations in detected wear) or be of poor quality (e.g., may exhibit inaccuracies in measurements) which may lead to an inconsistent bit wear model that jumps between sharp and dull prediction states over the predicted length of the wellbore hole making it difficult to predict wear or to optimize various parameters of the drill string to maximize efficiency of the drilling operation.

In accordance with this disclosure, an earth-boring tool system may use a machine-learning based bit wear model for predicting the wear of an earth-boring tool by using a bit wear trajectory regression curve algorithm to improve the stability and accuracy of predictions made by the bit wear model. For example, the earth-boring tool system may calculate a bit wear trajectory regression curve based on the data used to train the bit wear model. When using the bit wear model to make subsequent predictions based on new drilling data, the earth-boring tool system may encode the new drilling data into latent space, project the latent space representation of the new drilling data onto the bit wear trajectory regression curve and then decode the latent space representation of the projected new drilling data to make a bit wear prediction. Because the earth-boring tool system of the present disclosure is able to project input data of the bit wear model onto the bit wear trajectory regression curve, the earth-boring tool system is advantageous over conventional bit wear model generation systems. For instance, by projecting the latent space representation of input data onto a regression curve fitted to training data, the bit wear model may produce more stable and reliable results by eliminating outlier predictions that may have resulted from poor data quality or field data noise in the data used to train the bit wear model while still respecting and implementing the results of the data used to train the bit wear model. The ability to produce this more accurate, reliable, and stable prediction model may allow for more efficient drilling operations and may help to prevent loss of expensive down-hole equipment.

Stated another way, the earth-boring tool system of the present disclosure is advantageous over conventional earth-boring tool systems because the earth-boring tool system enables a bit wear model to be trained based on measured field data and to have a bit wear trajectory regression curve fitted to the training data to improve the reliability and stability of bit wear predictions. For instance, the model may be based, at least in part, on an encoder-decoder model. Once the model has been trained, the earth-boring tool system may receive new drilling data (e.g., real time drilling data). This new drilling data may be mapped to a latent space defined by the trained bit wear model. A smooth bit wear regression curve may then be calculated based on the data represented in latent space that was used to train the model. The new drilling data may then be projected onto the regression curve. The projected drilling data may then be "decoded" by the bit wear model to generate a bit wear prediction. Accordingly, because of the increased stability and reliability of the bit wear model, the earth-boring tool system may optimize one or more drilling parameters based on the bit wear model to increase the performance of one or more drilling tools included in the earth-boring tool system. For instance, the earth-boring tool system may optimize various parameters of one or more drilling tools to enable to drilling tools to increase the amount of time a drilling tool is able to perform before the tool must be repaired or replaced due to wear caused by the operation of the drilling tool compared to conventional systems.

FIG. 1 illustrates an earth-boring tool system 100 according to one or more embodiments of the present disclosure. An earth-boring tool system 100 may include a drill string 102. The earth-boring tool system 100 may also include electronics, such as sensors 114, sensor module 116, and/or tool control components 118. The drill string 102 may include multiple sections of drill pipe coupled together to form a long string of drill pipe. A forward end of the drill string 102 may include a bottom hole assembly 104 (BHA). The BHA 104 may include components, such as a motor 106 (e.g., mud motor), one or more reamers 108 and/or stabilizers 110, and an earth-boring tool 112 such as a drill bit. The drill string 102 may be inserted into a borehole 120. The borehole 120 may be formed by the earth-boring tool 112 as the drill string proceeds through a formation 122. The tool control components 118 may be configured to control an operational aspect of the earth-boring tool 112. For example, the tool control components 118 may include a steering component configured to change an angle of the earth-boring tool 112 with respect to the drill string 102 changing a direction of advancement of the drill string 102. The tool control components 118 may be configured to receive instructions from an operator at the surface and perform actions based on the instructions. In some embodiments, control instructions may be derived downhole within the tool control components 118, such as in a closed loop system, etc.

The sensors 114 may be configured to collect information regarding the earth-boring tool 112, such as tool temperature, cutter temperature, cutter wear, weight on bit (WOB), torque on bit (TOB), string rotational speed (RPM), and the wear (e.g., degradation, dulling, or damage) of at least part of the earth-boring tool 112. The information collected by the sensors 114 may be processed, stored, and/or transmitted by the sensor module 116. For example, the sensor module 116 may receive the information from the sensors 114 in the form of raw data, such as a voltage (e.g., 0-10 VDC, 0-5 VDC, etc.), an amperage (e.g., 0-20 mA, 4-20 mA, etc.), or a resistance (e.g., resistance temperature detector (RTD), thermistor, etc.). The sensor module 116 may process raw sensor data and transmit the data to the surface on a communication network, using a communication network protocol to transmit the raw sensor data. The communication network may include, for example a communication line, mud pulse telemetry, electromagnetic telemetry, wired pipe, etc. In some embodiments, the sensor module 116 may be configured to run calculations on raw sensed data such as, for example, calculating various signs of wear and/or damage to the earth-boring tool 112 relative to a known undamaged, unworn, or initial state of the earth-boring tool 112.

Though shown in FIG. 1 as being located at or near the mouth of the wellbore, the sensors 114 may be located anywhere (e.g., anywhere on the wellbore or located directly on the drill string 102 or the earth-boring tool 112) such that the sensors are able to detect wear of at least part of at least one drilling tool (e.g., earth-boring tool 112) as well as field drilling data and LWD data.

In some embodiments, the downhole information may be transmitted to the operator at the surface or to a computing device at the surface. For example, the downhole information may be provided to the operator through a display, a printout, etc. In some embodiments, the downhole information may be transmitted to a computing device that may process the information and provide the information to the operator in different formats useful to the operator. For example, measurements that are out of range may be provided in the form of alerts, warning lights, alarms, etc., some information may be provided live in the form of a display, spreadsheet, etc., whereas other information that may not be useful until further calculations are performed may be processed and the result of the calculation may be provided in the display, print out, spreadsheet, etc. In some embodiments, the sensor 114 may be configured to capture image data representative of various parts of the earth-boring tool 112 and provide the image data to the display. An operator may then manually measure, calculate, or otherwise obtain wear parameters of the earth-boring tool 112 based on the provided image data or other data collected by the sensor 114.

In some embodiments, the information sensed by the sensor 114 may be used to generate one or more bit wear models indicative of the predicted wear states of the earth-boring tool 112 over distance drilled in the formation 122. In some embodiments, the one or more bit wear models may be used to determine when at least part of the earth-boring tool 112 should be repaired or replaced. In additional embodiments, the one or more bit wear models may be used to optimize various operating parameters of the drill string for a drilling operation. For example, the earth-boring tool system 100 may automatically adjust one or more drilling parameters including, but not limited to, one or more of rate of penetration (ROP), drilling fluid flow rate, weight on bit (WOB), rotations per minute (RPM), well geometry, drilling fluid composition, etc. responsive to the generated bit wear model. In additional embodiments, the earth-boring tool system 100 may provide to the display one or more recommendations for changes to one or more drilling parameters responsive to the generated bit wear model. An operator may then approve one or more of the one or more recommendations or may manually change one or more drilling parameters based, at least part, on the recommendations.

Figure 7:
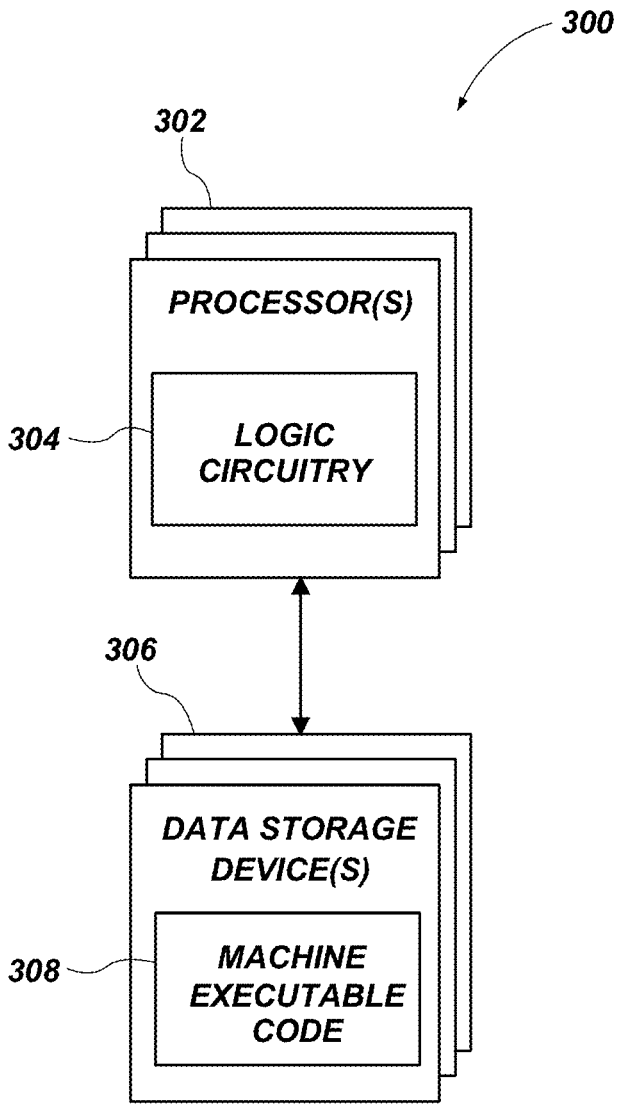
FIG. 7 is a block diagram of circuitry that, in some examples, may be used to implement various functions, operations, acts, processes, and/or methods disclosed herein.

The earth-boring tool system 100 may also include a processor and memory (discussed in more detail with regard to FIG. 7). Additionally, the earth-boring tool system 100 may also include an I/O interface and a communication interface. In one or more embodiments, the processor includes hardware for executing instructions, such as those making up a computer program. The memory may be used for storing data, metadata, and programs for execution by the processor(s). The I/O interface allows a user to provide input to, receive output from, and otherwise transfer data to and receive data from the earth-boring tool system 100 (e.g., to and from sensor 114 via sensor module 116). The communication interface can include hardware, software, or both. In any event, the communication interface can provide one or more interfaces for communication (such as, for example, packet-based communication) between the earth-boring tool system 100 and one or more other computing devices or networks.

Figure 2:
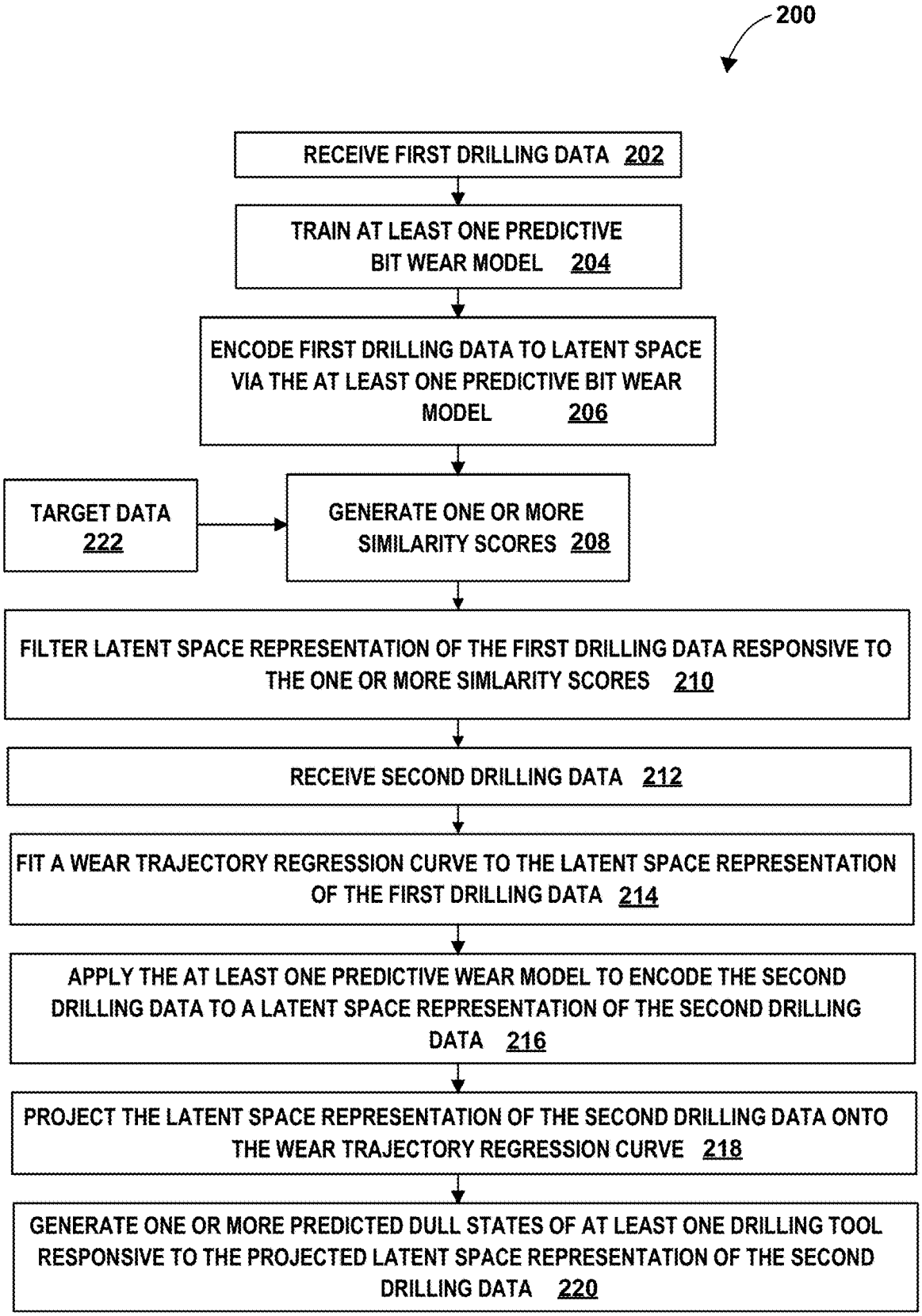
FIG. 2 is a flowchart illustration of an operation of the earth-boring tool system performed by a processor executing instructions stored on a computer-readable storage medium according to one or more embodiments of the present disclosure.

FIG. 2 is a flowchart 200 illustrating an operation of the earth-boring tool system 100 performed by a processor executing instructions stored on a computer-readable storage medium. For instance, FIG. 2 shows one or more embodiments of a simplified sequence-flow that the earth-boring tool system 100 utilizes to train machine learning models, generate one or more predictive models (e.g., predictive algorithms) for predicting one or more dull states of at least one drilling tool. As used herein, the phrase a "predictive model" may refer to a trained machine learning model for predicting (e.g., estimating) dull states for at least one drilling tool. At operation 202, the earth-boring tool system 100 receives first drilling data. For example, the first drilling data may include field drilling data, logging while drilling (LWD) data and data indicative of wear of at least part of the at least one drilling tool. The field drilling data may include one or more datasets corresponding to one or more wells (e.g., one or more wells of a drilling operation). The field drilling data and LWD data may include one or more of rock strength, rate of penetration (ROP), weight on bit (WOB), rotations per minute (RPM), well geometry formation geometry, formation density, tool geometry, formation composition, tool rotation, or formation logging data (e.g., gamma ray data, density and photoelectric index data, neutron porosity, resistivity data, image data (e.g., one or more images of a borehole), sonic data, formation pressure, formation fluid data, nuclear magnetic resonance (NMR), or seismic while drilling (SWD) data). As a non-limiting example, the first drilling data may include labeled data representing various dull states of one or more drilling tools that are associated with the field drilling data and LWD data for a given drilling operation. Stated another way, the first drilling data may represent various dull states of a drilling tool during a drilling operation as a function of depth and given the field drilling data and LWD data corresponding to the drilling operation.

In some embodiments, drilling data may be obtained via one or more sensors (e.g., sensor 114). For example, the one or more sensors maybe disposed along the length of a wellbore such that, when a drilling tool (e.g., earth-boring tool 112) passes through or is retrieved from the wellbore, the one or more sensors may capture or otherwise obtain data indicative of wear of at least part of the drilling tool. The one or more sensors may also be disposed on the drilling tool or on other parts included in the earth-boring tool system 100 so long as the one or more sensors are able to detect wear of at least part of at least one drilling tool (e.g., earth-boring tool 112). The one or more sensors may also detect field drilling data and LWD data during a drilling operation. In some embodiments, the one or more sensors may capture image data of the drilling tool and communicate (e.g., via sensor module 116), the image data to an operator. In some embodiments the one or more sensors may be configured to measure the wear state of the drilling tool relative to a known undamaged, unworn, or initial state of the drilling tool. In some embodiments, the data indicative of wear may be acquired manually. For example, an operator may measure the wear of a drilling tool at various points during a drilling operation. The operator may then provide to the earth-boring tool system 100 with the data the operator collected in the form of data indicative of wear of at least part of at least one drilling tool. In some embodiments, the first drilling data may be based, at least in part, on historical drilling data captured during previous drilling operations and stored for retrieval by the earth-boring tool system 100.

At operation 204, the earth-boring tool system 100 may train at least one predictive bit wear model for predicting one or more dull states of at least one drilling tool of the earth-boring tool system 100 based, at least in part, on the first drilling data. The at least one predictive bit wear model may be configured to encode the first drilling data into a latent space representation of the first drilling data. For example, the first drilling data may include labeled bit wear data such that, when the at least on predictive bit wear model generates a predicted bit wear state based on an input, the predicted bit wear state may be compared to the actual labeled bit wear state that corresponds to the input. The at least one predictive bit wear model may then automatically change one or more properties of the model responsive to the comparison.

As a non-limiting example, the at least one predictive bit wear model may be in the form of an encoder-decoder model that accepts the first drilling data (e.g., field drilling data or LWD data) as input and maps features of the first drilling data to a latent space representation of the first drilling data, as discussed above in operation 206. The at least one predictive bit wear model may then decode the latent space representation of the first drilling data to generate one or more predicted bit wear states of a drilling tool based on the output of the encoder. The earth-boring tool system 100 may then compare the one or more predicted bit wear states with the labeled bit wear data to generate a "closeness" score. If the closeness score is outside of an acceptable range, the decoder may automatically change one or more parameters or one or more weights associated with the one or more parameters at one or more nodes of the decoder and then use the first drilling data (e.g., the filtered latent space representation of the first data) to generate another prediction. This process may be repeated until the closeness score is within an acceptable range. In some embodiments, the decoder may be a trained machine learning model such as XGboost/SVM, or based on minimum distance, or any other conventional classification method using. For example, the decoder may be trained based on labeled data included in the first drilling data.

At operation 208, the earth-boring tool system 100 may compare the latent space representation of the first drilling data to target data (e.g., target data 222) to generate one or more similarity scores. For example, the target data 222 may be representative of field drilling data, bit wear data, or historic LWD data corresponding to drilling operations similar to a drilling operation yet to be undertaken. For example, the field drilling data, bit wear data, or historic LWD data may relate to properties of the formation to be drilled into. In some embodiments, the target data may be included in the first drilling data (e.g., a subset of the first drilling data). This target drilling data may be mapped to a latent space representation of the target drilling data using the at least one predictive bit wear model to be compared to the latent space representation of at least part of the first drilling data (e.g., one or more subsets of the first drilling data) to generate one or more similarity scores. For example, the first drilling data may include data representative of various parameters (e.g., formation properties) of one or more historical or simulated drilling operations. The target data may be compared to the first drilling data (e.g., one or more subsets of the first drilling data) in each dimension of the latent space. For example, in a latent space defined by dimensions Z1 and Z2, the earth-boring tool system 100 may compare the latent space distribution of the target data over Z1 to the latent space distribution of the first drilling data over Z1 and calculate the similarity between the two distributions. This process may be repeated for the Z2 dimension and for each dimension defining the latent space. This process may then also be repeated for each drilling operation represented in the first drilling data. For instance, the first drilling data may include data from a plurality of drilling operations. The target data 222 parameter distributions over each dimension of the latent space may then be compared to the distributions over each dimension of the latent space for each drilling operation of the represented plurality of drilling operations to calculate a similarity score for each respective drilling operation of the represented plurality of drilling operations.

After each distribution for a respective drilling operation has been compared to the distributions for the target data, a similarity score for the drilling operation represented in latent space may be calculated. This similarity score may then be used to filter the data correlating to the drilling operations represented in latent space to keep the data of the drilling operations that fall within a predetermined threshold of closeness to the target data where each drilling operation of the first drilling data may have a correlating calculated similarity score quantifying the similarity between the respective drilling operation data and the target data. After one or more similarity scores have been calculated, the earth-boring tool system 100 may then filter the latent space representation of the first drilling data to include the data from the one or more historical or simulated drilling operations that are within a closeness threshold relative to the target data 222 (e.g., closest 5, 10, 50, 100, or any other number of drilling operations represented in the latent space representation of the first drilling data), as shown in operation 210. In some embodiments, the earth-boring tool system 100 may filter the first drilling data responsive to the one or more similarity scores have been calculated. As a non-limiting example, the earth-boring tool system 100 may filter one or more data subsets of the first drilling data and use the filtered first drilling data to train the at least one predictive bit wear model. In this example, the at least one predictive bit wear model may map the first drilling data to a latent space representation of the first drilling data, but not use the first drilling data to train the at least one predictive bit wear model until the first drilling data has been filtered responsive to the one or more similarity scores.

At operation 212, the earth-boring tool system 100 may receive second drilling data via the one or more sensors. Though shown in flowchart 200 as occurring after operation 210, the present disclosure is not so limited. As one non-limiting example, the earth-boring tool system 100 may receive the second drilling data before generating one or more similarity scores based on the target data 222. In this example, the second drilling data may include the target data (e.g., as a subset of the second drilling data). The second drilling data may include field drilling data, LWD data, and data indicative of wear of at least part of the at least one drilling tool. The second drilling data may be indicative of data captured by the earth-boring tool system 100 in real time during operation of the earth-boring tool system. For example, the second drilling data may be received as described above with regard to the first drilling data via the sensors 114.

At operation 214, the earth-boring tool system 100 may fit a wear trajectory regression curve to the latent space representation of data used to train the at least one predictive bit wear model (e.g., the filtered latent space representation of the first drilling data). For example, the wear trajectory regression curve may define a smoothed curve that fits the data (e.g., the field drilling data and the LWD data of the first drilling data) that has been mapped into latent space. At operation 216, the earth-boring tool system 100 may apply the at least one predictive wear model to encode the second drilling data to a latent space representation of the second drilling data. At operation 218, the earth-boring tool system 100 may then project the latent space representation of the second drilling data onto the wear trajectory regression curve. For example, the earth-boring tool system 100 may project the latent space representation of the second drilling data onto a point of the trajectory regression curve that is closest to the latent space representation of the second drilling data. Stated another way, the latent space representation of the second drilling data may be projected onto a point located on the trajectory regression curve that is the shortest distance in latent space between the latent space representation of the second drilling data and the trajectory regression curve.

In some embodiments, the latent space representation of the second drilling data may be projected onto the trajectory regression curve responsive to the latent space representation of the second drilling data exceeding a predetermined threshold. For example, the earth-boring tool system 100 may project the latent space representation of the second drilling data if the latent space representation of the second drilling data exceeds a predetermined distance in latent space from the trajectory regression curve (e.g., a distance in latent space between the latent space representation of the second drilling data and a closest point on the trajectory regression curve). In this example, the earth-boring tool system 100 may not project the latent space representation of the second drilling data onto the trajectory regression curve if the latent space representation of the second drilling data is within the predetermined distance from the trajectory regression curve.

At operation 220, the earth-boring tool system 100 may generate one or more predicted dull states of at least one drilling tool responsive to the projected latent space representation of the drilling data. For example, the earth-boring tool system 100 may decode, via the at least one predictive bit wear model, the projected latent space representation of the second drilling data to generate at least one predicted dull state of the at least one drilling tool. In some embodiments, the at least one predicted dull state of the at least one drilling tool may be in the form of a wear vs drilling depth curve or gradient representing a predicted wear of at least one drilling tool of the earth-boring tool system 100 as a function of drilling depth of the at least one drilling tool.

Additionally, in one or more embodiments, the earth-boring tool system 100 may generate a warning indicative of a need to replace at least part of the at least one drilling tool responsive to the generated at least one predicted dull state of the at least one drilling tool. For example, the predictive bit wear model may be configured to predict a depth at which one or more drilling tools is at an increased risk of failure, excessive damage, or when a drilling tool requires replacement to mitigate these risks. As a specific, non-limiting example, the earth-boring tool system 100 may detect when a drilling tool has reached a depth that is indicated by the generated at least one predicted dull state of the at least one drilling tool to have exceeded a predetermined threshold for wear. The earth-boring tool system 100 may then generate a warning that at least part of the at least one drilling tool need to be replaced or repaired to prevent tool failure or excessive damage. In some embodiments, the earth-boring tool system may then provide to an operator via a display of the earth-boring tool system, the generated warning.

In some embodiments, the earth-boring tool system 100 may then automatically change one or more operational drilling parameters of the drill string 102 responsive to detecting the increased risk of failure or excessive damage. For example, the earth-boring tool system 100 may change one or more operational drilling parameters known to reduce the likelihood of damage to at least one drilling tool (e.g., earth-boring tool 112). As a specific non-limiting example, when the earth-boring tool system 100 detects that one or more drilling tools has reached a depth where the at least one predicted bit wear state indicates that the wear of one or more drilling tools will have crossed a predetermined threshold, the earth-boring tool system may cease drilling operations unless manually overridden by an operator. For example, the warning displayed to an operator may include a selectable option to override the warning where, if the warning is not overridden, the earth-boring tool system 100 may cease operations after a predetermined length of time has elapsed. If, however, the operator selects the override option before expiration of the predetermined length of time, the earth-boring tool system 100 may continue operation uninterrupted. The earth-boring tool system 100 may also display, along with the warning, a selectable option to immediately cease drilling operations or to modify one or more drilling operations. Furthermore, the earth-boring tool system 100 may also present, with the warning, one or more recommendations. For example, the one or more recommendations may recommend changing one or more operational drilling parameters of the drill string 102 as well as recommended values. An operator may then, upon selecting the option to modify the operational drilling parameters of the drill string, select to implement the recommended values or manually input different values.

Figure 3:
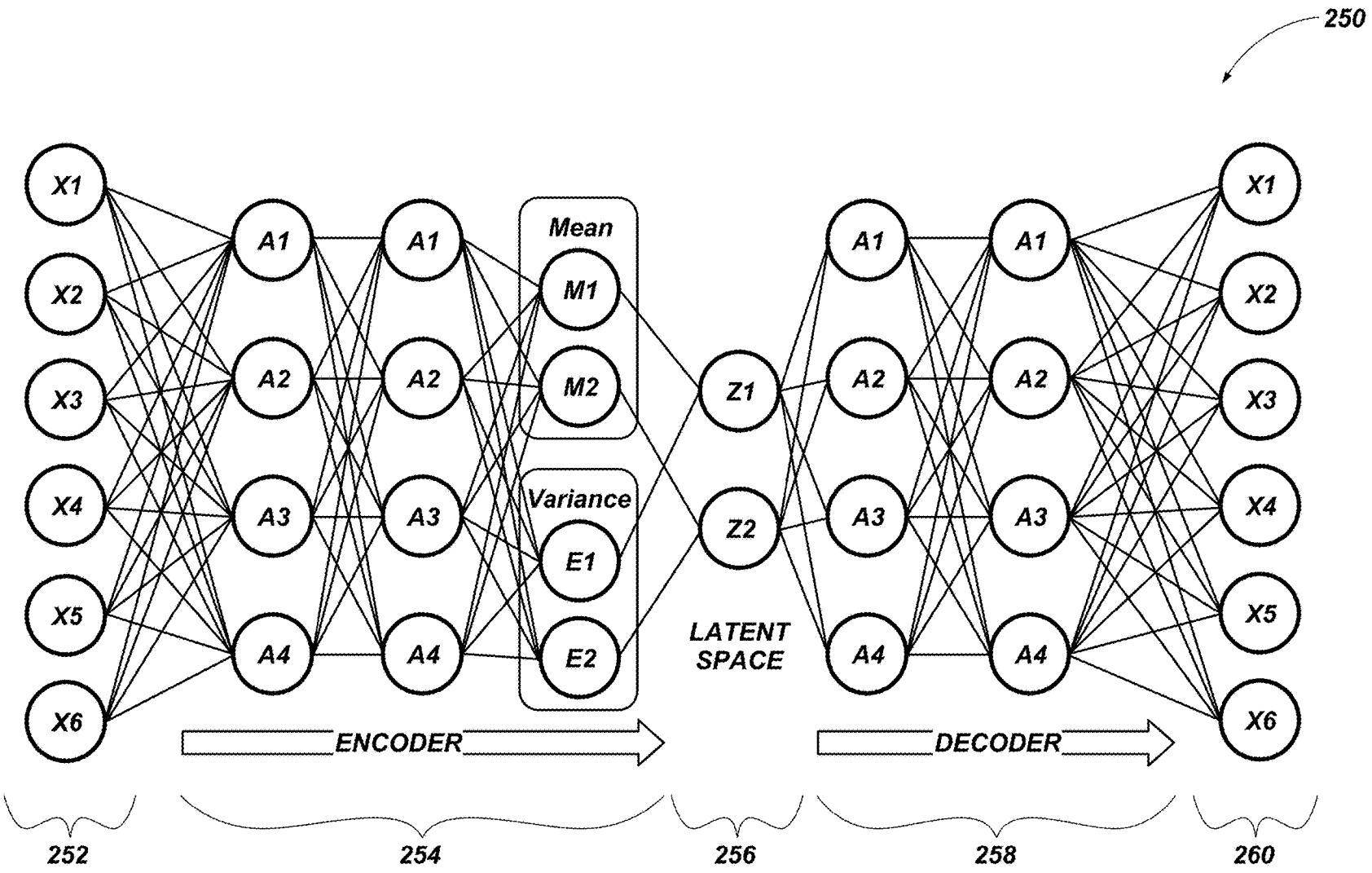
FIG. 3 is an illustration of an example predictive bit wear model in the form of an encoder-decoder model, according to one or more embodiments of the present disclosure.

FIG. 3 is an illustration of an example encoder-decoder machine learning model (e.g., a predictive bit wear model). The encoder-decoder model may include input data 252, an encoder 254, a latent space 256, a decoder 258, and an output 260. For example, the encoder-decoder model may receive input data 252 (e.g., field drilling data, LWD data, or bit wear data). The input data may then be encoded into latent space 256 via the encoder 254 to a compressed (e.g., reduced dimensionality) representation of the input data 252. The decoder 258 may then decode the latent space representation of the input data 252 to generate an output 260 representing a predicted bit wear state of at least one drilling tool of the earth-boring tool systems 100. The size of the input and the size of the output may be different. The encoder-decoder model may be trained using any conventionally known machine learning technique to produce a desired output based on a given input (e.g., supervised learning, unsupervised learning, without limitation). In some embodiments, the at least one predictive bit wear model may be in the form of an auto-encoder configured to extract relevant features automatically from a given input for mapping the input to a latent state representation of the input. Though shown in FIG. 3 as using an encoder-decoder machine learning method, the earth-boring tool system 100 of the present disclosure is not so limited. Accordingly, any machine learning method may be used so long as the earth-boring tool system 100 is able to receive drilling data corresponding to one or more drilling tools and train a predictive bit wear model using the received drilling data to predict the wear of the one or more drilling tools as a function of distance the one or more drillings tools have bored into a formation (e.g., a rock formation).

Figure 4:
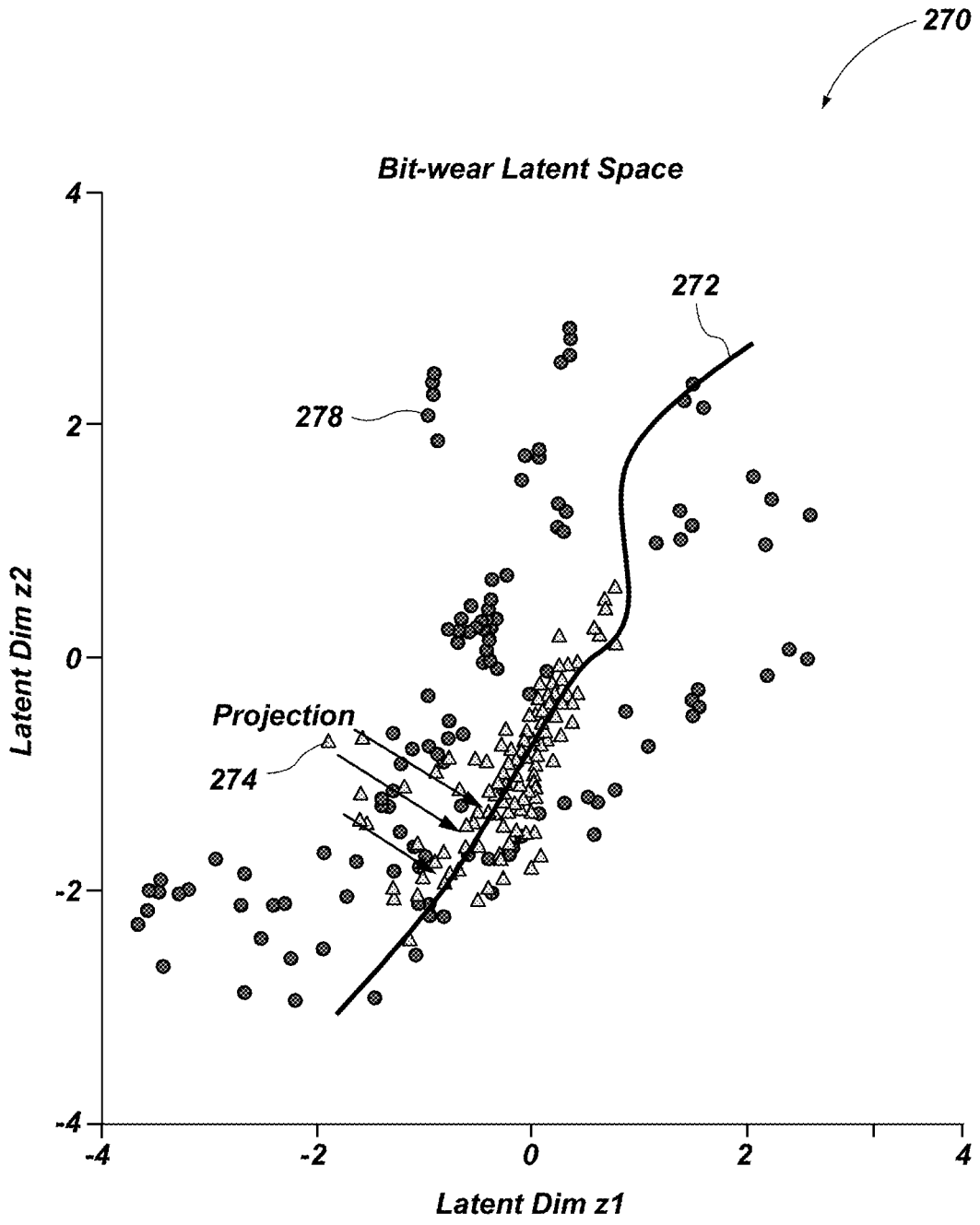
FIG. 4 is a graph illustrating a plurality of bit wear state predictions represented in latent space, according to one or more embodiments of the present disclosure.

FIG. 4 is a graph 270 illustrating a plurality of bit wear state predictions represented in latent space. Graph 270 includes a plurality of bit wear states used for training (e.g., bit wear state 278) that are represented in the graph as circles. Graph 270 also includes a plurality of bit wear state predictions (e.g., predicted bit wear state 274), represented as triangles, and based on real-time input data. Graph 270 also includes a bit wear trajectory regression curve 272. As shown in FIG. 4, a bit wear trajectory regression curve 272 may be fitted to plurality of bit wear states used for training that are represented in latent space. After the regression curve has been fitted to the training data, one or more second data sets (e.g., second drilling data) may be received in real-time. The one or more second data sets may then be mapped to latent space and represent a bit wear state prediction based, at least in part, on the one or more second input data sets. As shown in FIG. 4, one or more real-time bit wear predictions represented in latent space may be mapped onto the bit wear trajectory regression curve 272 to improve model stability and accuracy when decoded to generate a predicted bit wear state.

Figure 5:
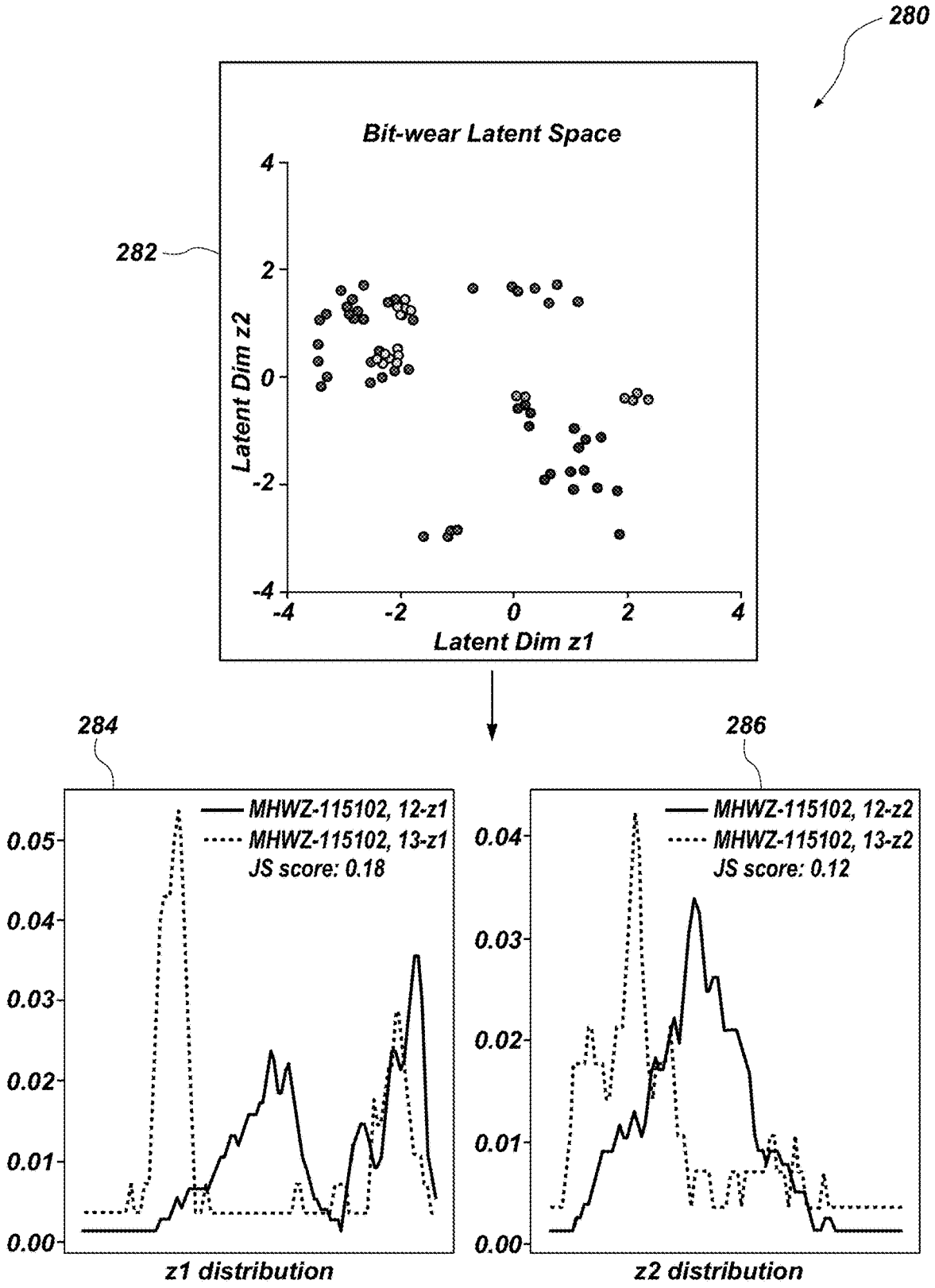
FIG. 5 is a diagram illustrating an example method of comparing latent space representations of data to calculate a similarity score, according to one or more embodiments of the present disclosure.

FIG. 5 is a diagram 280 illustrating an example method of comparing latent space representations of data to calculate a similarity score, according to one or more embodiments. For example, the earth-boring tool system 100 may calculate the similarity between input features of target data (e.g., estimated features of a well yet to be drilled) and one or more input features corresponding to historic or simulated well runs (e.g., drilling operations) represented in latent space. As shown in FIG. 5, the latent space distribution of the latent space representation of input features may be viewed for each dimension of the latent space. For example, latent space graph 282 illustrates two dimensions, Z1 and Z2. The earth-boring tool system 100 may compare the latent space distributions of various input parameters over each dimension to calculate a similarity score. For example, in graph 284, the earth-boring tool system 100 compares a distribution of a target data set (e.g., data relating to a well yet to be drilled and mapped into latent space) to data corresponding to a historic or simulated drilling operation (e.g., formation properties) represented in the training data. A similarity score may be calculated responsive to this comparison. For example, the earth-boring tool system 100 may calculate how much area beneath the line representations of each data set are shared between each data set over a dimension of the latent space. The more shared area between data sets the greater the similarity that is reflected in the similarity score. This process may be repeated for each dimension of the latent space (e.g., in this case repeated for Z2 as shown in graph 286). The similarity scores over each dimension of the latent space may then be summed, averaged (e.g., via mean, median, or any other method of averaging), or otherwise compiled to calculate an overall similarity score. This process may be repeated for each training data set represented in the latent space to calculate a corresponding similarity score between the target data set and each training data set. The earth-boring tool system 100 may then filter the latent space to represent only those training data sets within a predetermined similarity score threshold (e.g., closest 10, 50, or 100 training data sets, without limitation).

Figure 6:
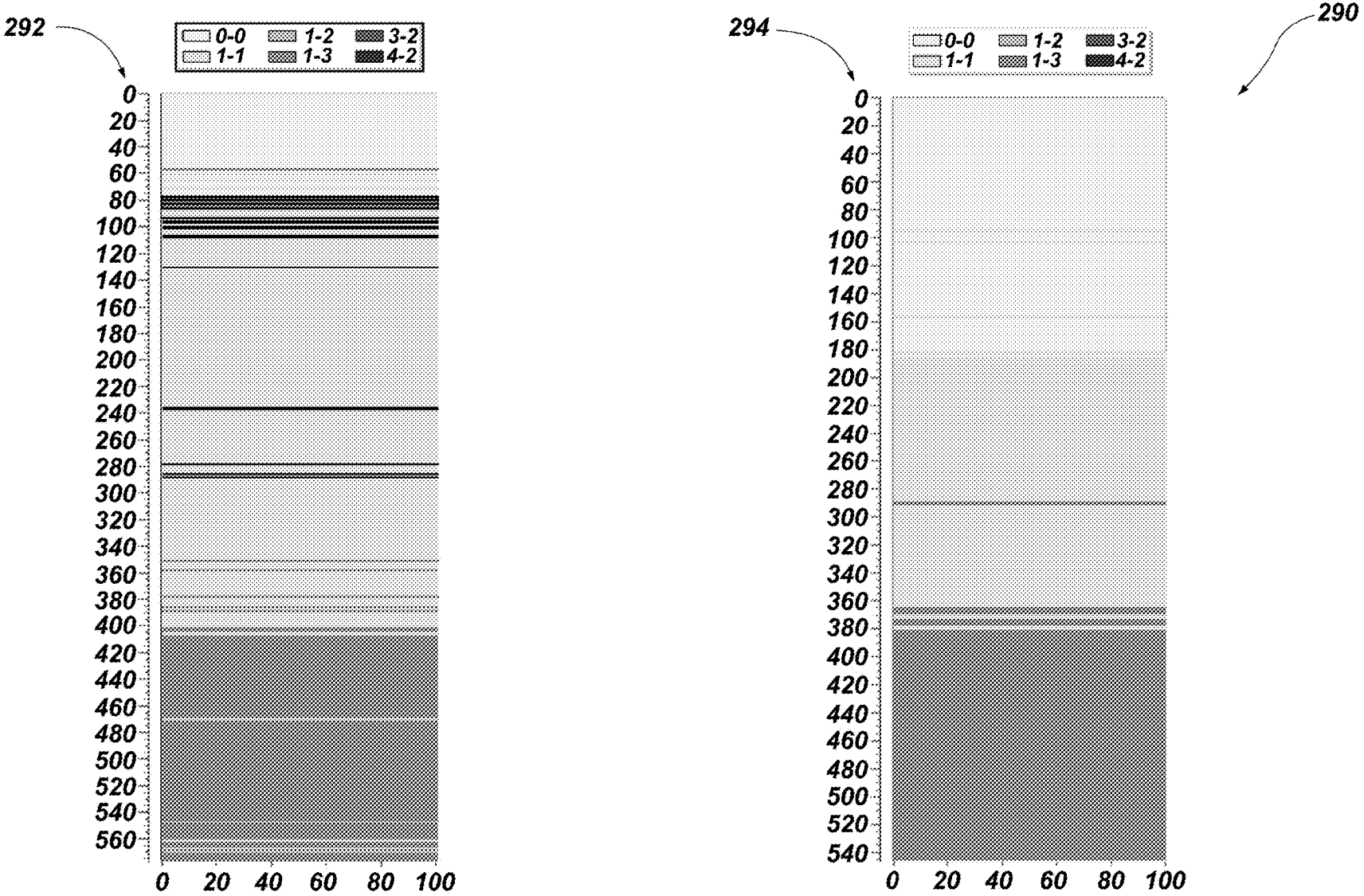
FIG. 6 is a diagram illustrating a plurality of predicted bit wear states as predicted before and after incorporating latent space projections of the latent space representations of input data onto a trajectory regression curve, according to one or more embodiments of the present disclosure.

FIG. 6 is a diagram 290 illustrating a plurality of predicted bit wear states as predicted before and after incorporating latent space projections of the latent space representations of input data onto a trajectory regression curve. The diagram 290 includes a first bit wear graph 292 and a second bit wear graph 294 where the first and second bit wear graphs 292 and 294 illustrate a plurality of bit wear states of at least one drilling tool as a function of depth in feet. Various levels of sharpness shown in the first and second graphs 292 and 294 are indicated by different gradients. Moreover, the gradients correlate with numerical indicators where 0-0 indicates a predicted sharp or unworn state of at least one drilling tool and 4-2 represents a highest predicted wear state of at least one drilling tool. First bit wear graph 292 represents a plurality of bit wear state predictions derived from a predictive bit wear model that does not incorporate projecting latent space representations of data onto a linear regression curve fitted to training data represented in latent space. As shown in FIG. 6, sparse or inaccurate field data may create inconsistencies in the predictive capabilities of a predictive bit wear model. For example, graph 292 illustrates the instability that may be exhibited by a predictive bit wear model configured to make predictions based solely on sparse or inaccurate training data. As shown in FIG. 6, the sparse or inaccurate data may lead to outlier predictions that reflect the sparse or inaccurate training data and which causes erratic bit wear predictions. For example, the erratic bit wear predictions at depths between about 80 feet to about 110 feet. In contrast, graph 294 represents a plurality of predicted bit wear states incorporating projecting latent space representations of input data onto a regression curve fitted to training data. As shown in the second bit wear graph 294, by projecting the latent space representation of input data onto a regression curve fitted to training data, the plurality of bit wear predictions exhibit more stability, accuracy, and consistency.

It will be appreciated by those of ordinary skill in the art that functional elements of examples disclosed herein (e.g., functions, operations, acts, processes, and/or methods) may be implemented in any suitable hardware, software, firmware, or combinations thereof. FIG. 7 illustrates non-limiting examples of implementations of functional elements disclosed herein. In some examples, some or all portions of the functional elements disclosed herein may be performed by hardware specially configured for carrying out the functional elements.

FIG. 7 is a block diagram of circuitry 300 that, in some examples, may be used to implement various functions, operations, acts, processes, and/or methods disclosed herein. The circuitry 300 includes one or more processors 302 (sometimes referred to herein as "processors 302") operably coupled to one or more data storage devices (sometimes referred to herein as "storage 304"). The storage 304 includes machine executable code 306 stored thereon and the processors 302 include logic circuitry 308. The machine executable code 306 includes information describing functional elements that may be implemented by (e.g., performed by) the logic circuitry 308. The logic circuitry 308 is adapted to implement (e.g., perform) the functional elements described by the machine executable code 306. The circuitry 300, when executing the functional elements described by the machine executable code 306, should be considered as special purpose hardware configured for carrying out functional elements disclosed herein. In some examples the processors 302 may perform the functional elements described by the machine executable code 306 sequentially, concurrently (e.g., on one or more different hardware platforms), or in one or more parallel process streams.

When implemented by logic circuitry 308 of the processors 302, the machine executable code 306 is to adapt the processors 302 to perform operations of examples disclosed herein. For example, the machine executable code 306 may adapt the processors 302 to perform at least a portion or a totality of the operation 200 of FIG. 2. As another example, the machine executable code 306 may adapt the processors 302 to perform at least a portion or a totality of the operations discussed for the system of FIG. 1. As a specific, non-limiting example, the machine executable code 306 may adapt the processors 302 to train a predictive bit wear model. As another non-limiting example, the machine executable code 306 may adapt the processors to Project latent space representations of data onto a linear trajectory regression curve.

The processors 302 may include a general purpose processor, a special purpose processor, a central processing unit (CPU), a microcontroller, a programmable logic controller (PLC), a digital signal processor (DSP), an application specific integrated circuit (ASIC), a field-programmable gate array (FPGA) or other programmable logic device, discrete gate or transistor logic, discrete hardware components, other programmable device, or any combination thereof designed to perform the functions disclosed herein. A general-purpose computer including a processor is considered a special-purpose computer while the general-purpose computer executes functional elements corresponding to the machine executable code 306 (e.g., software code, firmware code, hardware descriptions) related to examples of the present disclosure. It is noted that a general-purpose processor (may also be referred to herein as a host processor or simply a host) may be a microprocessor, but in the alternative, the processors 302 may include any conventional processor, controller, microcontroller, or state machine. The processors 702 may also be implemented as a combination of computing devices, such as a combination of a DSP and a microprocessor, a plurality of microprocessors, one or more microprocessors in conjunction with a DSP core, or any other such configuration.

In some examples the storage 304 includes volatile data storage (e.g., random-access memory (RAM)), non-volatile data storage (e.g., Flash memory, a hard disc drive, a solid state drive, erasable programmable read-only memory (EPROM), etc.). In some examples the processors 302 and the storage 304 may be implemented into a single device (e.g., a semiconductor device product, a system on chip (SOC), etc.). In some examples the processors 302 and the storage 304 may be implemented into separate devices.

In some examples the machine executable code 306 may include computer-readable instructions (e.g., software code, firmware code). By way of non-limiting example, the computer-readable instructions may be stored by the storage 304, accessed directly by the processors 302, and executed by the processors 302 using at least the logic circuitry 308. Also by way of non-limiting example, the computer-readable instructions may be stored on the storage 304, transferred to a memory device (not shown) for execution, and executed by the processors 302 using at least the logic circuitry 308. Accordingly, in some examples the logic circuitry 308 includes electrically configurable logic circuitry 308.

In some examples the machine executable code 306 may describe hardware (e.g., circuitry) to be implemented in the logic circuitry 308 to perform the functional elements. This hardware may be described at any of a variety of levels of abstraction, from low-level transistor layouts to high-level description languages. At a high-level of abstraction, a hardware description language (HDL) such as an IEEE Standard hardware description language (HDL) may be used. By way of non-limiting examples, VERILOG™, SYSTEMVERILOG™ or very large scale integration (VLSI) hardware description language (VHDL™) may be used.

HDL descriptions may be converted into descriptions at any of numerous other levels of abstraction as desired. As a non-limiting example, a high-level description may be converted to a logic-level description such as a register-transfer language (RTL), a gate-level (GL) description, a layout-level description, or a mask-level description. As a non-limiting example, micro-operations to be performed by hardware logic circuits (e.g., gates, flip-flops, registers, without limitation) of the logic circuitry 308 may be described in a RTL and then converted by a synthesis tool into a GL description, and the GL description may be converted by a placement and routing tool into a layout-level description that corresponds to a physical layout of an integrated circuit of a programmable logic device, discrete gate or transistor logic, discrete hardware components, or combinations thereof. Accordingly, in some examples the machine executable code 706 may include an HDL, an RTL, a GL description, a mask level description, other hardware description, or any combination thereof.

In examples where the machine executable code 306 includes a hardware description (at any level of abstraction), a system (not shown, but including the storage 304) may implement the hardware description described by the machine executable code 306. By way of non-limiting example, the processors 302 may include a programmable logic device (e.g., an FPGA or a PLC) and the logic circuitry 308 may be electrically controlled to implement circuitry corresponding to the hardware description into the logic circuitry 308. Also by way of non-limiting example, the logic circuitry 308 may include hard-wired logic manufactured by a manufacturing system (not shown, but including the storage 304) according to the hardware description of the machine executable code 306.

Regardless of whether the machine executable code 306 includes computer-readable instructions or a hardware description, the logic circuitry 308 is adapted to perform the functional elements described by the machine executable code 306 when implementing the functional elements of the machine executable code 306. It is noted that although a hardware description may not directly describe functional elements, a hardware description indirectly describes functional elements that the hardware elements described by the hardware description are capable of performing.

As used in the present disclosure, the terms "module" or "component" may refer to specific hardware implementations to perform the actions of the module or component and/or software objects or software routines that may be stored on and/or executed by general purpose hardware (e.g., computer-readable media, processing devices, etc.) of the computing system. In some examples, the different components, modules, engines, and services described in the present disclosure may be implemented as objects or processes that execute on the computing system (e.g., as separate threads). While some of the system and methods described in the present disclosure are generally described as being implemented in software (stored on and/or executed by general purpose hardware), specific hardware implementations or a combination of software and specific hardware implementations are also possible and contemplated.

As used in the present disclosure, the term "combination" with reference to a plurality of elements may include a combination of all the elements or any of various different subcombinations of some of the elements. For example, the phrase "A, B, C, D, or combinations thereof" may refer to any one of A, B, C, or D; the combination of each of A, B, C, and D; and any subcombination of A, B, C, or D such as A, B, and C; A, B, and D; A, C, and D; B, C, and D; A and B; A and C; A and D; B and C; B and D; or C and D.

Terms used in the present disclosure and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to examples containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

While the present disclosure has been described herein with respect to certain illustrated examples, those of ordinary skill in the art will recognize and appreciate that the present invention is not so limited. Rather, many additions, deletions, and modifications to the illustrated and described examples may be made without departing from the scope of the invention as hereinafter claimed along with their legal equivalents. In addition, features from one example may be combined with features of another example while still being encompassed within the scope of the invention as contemplated by the inventor.

What is claimed is:

1. An earth-boring tool system comprising:

a drill string comprising at least one drilling tool;

one or more sensors configured to sense wear of the at least one drilling tool;

at least one processor;

at least one non-transitory computer readable storage medium storing instructions thereon that, when executed by the at least one processor, cause the earth-boring tool system to:

receive first drilling data including field drilling data, logging while drilling (LWD) data and data indicative of wear of at least part of the at least one drilling tool;

train at least one predictive bit wear model for predicting one or more dull states of the at least one drilling tool based, at least in part, on the first drilling data, the predictive bit wear model configured to encode the first drilling data into a latent space representation of the first drilling data;

fit a wear trajectory regression curve to the latent space representation of the first drilling data;

generate one or more predicted dull states of the at least one drilling tool based, at least in part, on the predictive bit wear model and the wear trajectory regression curve;

receive second drilling data including field drilling data, logging while drilling (LWD) data and data indicative of wear of at least part of the at least one drilling tool via the one or more sensors;

utilize the at least one predictive bit wear model to encode the second drilling data into a latent space representation of the second drilling data; and project the latent space representation of the second drilling data onto the wear trajectory regression curve.

2. The earth-boring tool system of claim 1, wherein the instructions stored on the at least one computer readable storage medium, when executed by the at least one processor, cause the earth-boring tool system to:

generate one or more predicted dull states of the at least one drilling tool responsive to the projected latent space representation of the second drilling data via the predictive bit wear model.

3. The earth-boring tool system of claim 1, wherein the instructions stored on the at least one computer readable storage medium, when executed by the at least one processor, cause the earth-boring tool system to:

project the latent space representation of the second drilling data onto the wear trajectory regression curve responsive to the latent space representation of the second drilling data exceeding a predetermined threshold.

4. The earth-boring tool system of claim 3, wherein the predetermined threshold is based, at least in part, on a distance, in latent space, between the latent space representation of the second drilling data and a closest point on the wear trajectory regression curve.

5. The earth-boring tool system of claim 1, wherein the instructions stored on the at least one computer readable storage medium, when executed by the at least one processor, cause the earth-boring tool system to:

decode the projected latent space representation of the second drilling data to generate at least one predicted dull state of the at least one drilling tool.

6. The earth-boring tool system of claim 5, wherein the instructions stored on the at least one computer readable storage medium, when executed by the at least one processor, cause the earth-boring tool system to:

modify one or more drilling parameters of the at least one drilling tool responsive to the at least one predicted dull state.

7. The earth-boring tool system of claim 1, wherein the first drilling data includes one or more of rock strength, rate of penetration (ROP), weight on bit (WOB), rotations per minute (RPM), torque on bit, formation logging data, well geometry, formation geometry, formation density, tool geometry, formation composition, or tool rotation.

8. The earth-boring tool system of claim 1, wherein the first drilling data includes labeled data from one or more historical drilling operations.

9. The earth-boring tool system of claim 1, wherein the instructions stored on the at least one computer readable storage medium, when executed by the at least one processor, cause the earth-boring tool system to:

generate one or more similarity scores responsive to comparing the latent space representation of the first drilling data to target drilling data; and filter the first drilling data or the latent space representation of the first drilling data responsive to the one or more similarity scores.

10. The earth-boring tool system of claim 1, wherein the instructions stored on the at least one computer readable storage medium, when executed by the at least one processor, cause the earth-boring tool system to:

generate a warning indicative of a need to replace at least part of the at least one drilling tool; and provide to an operator via a display of the earth-boring tool system, the generated warning.

11. A method for obtaining a bit wear model, the method comprising:

receiving first drilling data from an earth-boring tool system, the first drilling data including field drilling data, logging while drilling (LWD) data and data indicative of wear of at least part of the at least one drilling tool;

training at least one predictive bit wear model for predicting one or more dull states of the at least one drilling tool based, at least in part, on the first drilling data, the predictive bit wear model configured to encode the first drilling data into a latent space representation of the first drilling data;

generating one or more similarity scores responsive to comparing the latent space representation of the first drilling data to target drilling data; and filtering the first drilling data or the latent space representation of the first drilling data responsive to the one or more similarity scores.

12. The method of claim 11, further comprising:

receiving second drilling data including field drilling data, logging while drilling (LWD) data and data indicative of wear of at least part of the at least one drilling tool via one or more sensors;

fitting a wear trajectory regression curve to the filtered latent space representation of the first drilling data; and utilizing the at least one predictive bit wear model to encode the second drilling data into a latent space representation of the second drilling data.

13. The method of claim 12, further comprising:

projecting the latent space representation of the second drilling data onto the wear trajectory regression curve; and generating one or more predicted dull states of the at least one drilling tool based, at least in part, on the predictive bit wear model and the wear trajectory regression curve.

14. The method of claim 13, wherein generating one or more predicted dull states of the at least one drilling tool based, at least in part, on the predictive bit wear model and the wear trajectory regression curve comprises generating one or more predicted dull states of the at least one drilling tool responsive to decoding the projected latent space representation of the second drilling data via the at least one predictive bit wear model.

15. The method of claim 13, wherein projecting the latent space representation of the second drilling data onto the wear trajectory regression curve comprises projecting the latent space representation of the second drilling data onto the wear trajectory curve responsive to the latent space representation of the second drilling data exceeding a predetermined threshold.

16. The method of claim 15, wherein the predetermined threshold is based, at least in part, on a distance, in latent space, between the latent space representation of the second drilling data and a closest point on the wear trajectory regression curve.

17. The method of claim 11, further comprising:

receiving third drilling data from an earth-boring tool system;

receiving labeled drilling data correlating to the third drilling data; and validating the at least one predictive bit wear model responsive to the third drilling data and the labeled drilling data.

18. The method of claim 11, wherein the first drilling data includes labeled data from one or more historical drilling operations.

19. A non-transitory computer-readable medium storing instructions thereon that, when executed by the at least one processor, cause the at least one processor to perform the steps comprising:

receiving first drilling data including field drilling data, logging while drilling (LWD) data and data indicative of wear of at least part of the at least one drilling tool;

training at least one predictive bit wear model for predicting one or more dull states of the at least one drilling tool based, at least in part, on the first drilling data, the predictive bit wear model configured to encode the first drilling data into a latent space representation of the first drilling data;

generating one or more similarity scores responsive to comparing the latent space representation of the first drilling data to target drilling data;

filtering the first drilling data or the latent space representation of the first drilling data responsive to the one or more similarity scores, fitting a wear trajectory regression curve to the filtered latent space representation of the first drilling data; and generating one or more predicted dull states of the at least one drilling tool based, at least in part, on the predictive bit wear model and the wear trajectory regression curve.

* * * * *